US011043774B2

(12) United States Patent
Ko et al.

(10) Patent No.: US 11,043,774 B2
(45) Date of Patent: Jun. 22, 2021

(54) CONNECTOR HAVING SURGE PREVENTION FUNCTION AND CIRCUIT BOARD INCLUDING SAME

(71) Applicant: LG Chem, Ltd., Seoul (KR)

(72) Inventors: Dong-Wan Ko, Daejeon (KR); Ki-Young Lee, Daejeon (KR)

(73) Assignee: LG Chem, Ltd.

( * ) Notice: Subject to any disclaimer, the term of this patent is extended or adjusted under 35 U.S.C. 154(b) by 0 days.

(21) Appl. No.: 16/757,842

(22) PCT Filed: Feb. 27, 2019

(86) PCT No.: PCT/KR2019/002387

§ 371 (c)(1),
(2) Date: Apr. 21, 2020

(87) PCT Pub. No.: WO2019/240353

PCT Pub. Date: Dec. 19, 2019

(65) Prior Publication Data

US 2021/0083431 A1 Mar. 18, 2021

(30) Foreign Application Priority Data

Jun. 12, 2018 (KR) ..... 10-2018-0067736

(51) Int. Cl.
*H01R 13/648* (2006.01)
*H01R 12/57* (2011.01)
(Continued)

(52) U.S. Cl.
CPC ..... *H01R 13/648* (2013.01); *H01R 12/57* (2013.01); *H01R 13/04* (2013.01); *H01R 13/10* (2013.01);
(Continued)

(58) Field of Classification Search
CPC ..... H01R 13/648; H01R 12/57; H01R 13/04; H01R 13/10; H01R 13/629; H01R 13/53;
(Continued)

(56) References Cited

U.S. PATENT DOCUMENTS 5,632,635 A 5/1997 Vanbesien et al.
5,662,483 A 9/1997 Park et al.
(Continued)

FOREIGN PATENT DOCUMENTS

EP 1098401 A1 5/2001
JP H08236216 A 9/1996
(Continued)

OTHER PUBLICATIONS

International Search Report for Application No. PCT/KR2019/002387 dated Jun. 28, 2019, 2 pages.
(Continued)

*Primary Examiner* — Tho D Ta
(74) *Attorney, Agent, or Firm* — Lerner, David, Littenberg, Krumholz & Mentlik, LLP

(57) ABSTRACT

A male connector, which is connected to or disconnected from a female connector, and includes a male connector housing, male connector pins disposed in an inner space of the male connector housing, and a ground connection member having one side connected to the male connector pins and the other side connected to an inner wall of the male connector housing, wherein the ground connection member is provided in plural, and wherein the plurality of ground connection members are respectively connected to the male connector pins in one-to-one relationship and are detachably connected to the male connector pins, respectively, at positions spaced from front ends of the male connector pins by predetermined distances such that the plurality of ground connection members are separated in sequence from the
(Continued)

male connector pin by the female connector according to a depth by which the female connector is inserted into the male connector housing.

8 Claims, 6 Drawing Sheets

(51) Int. Cl.

| | |
|---|---|
| ***H01R 13/10*** | (2006.01) |
| ***H01R 13/04*** | (2006.01) |
| ***H01R 13/629*** | (2006.01) |
| *H01R 107/00* | (2006.01) |
| *H01R 13/53* | (2006.01) |

(52) U.S. Cl.
CPC ..... *H01R 13/629* (2013.01); *H01R 13/53* (2013.01); *H01R 2107/00* (2013.01)

(58) Field of Classification Search
CPC ..... H01R 2107/00; Y10S 439/9241; Y10S 439/9242
See application file for complete search history.

(56) References Cited

U.S. PATENT DOCUMENTS

| | | | | |
|---|---|---|---|---|
| 5,692,916 | A | 12/1997 | Halasz | |
| 6,155,855 | A | 12/2000 | Weil et al. | |
| 6,186,805 | B1 | 2/2001 | Krishnaswamy et al. | |
| 9,520,661 | B1 * | 12/2016 | Horning | H01R 12/716 |
| 9,583,881 | B2 * | 2/2017 | Yan | H01R 12/585 |
| 9,879,864 | B2 | 1/2018 | Gutierrez et al. | |
| 9,989,990 | B2 * | 6/2018 | Kotzur | G06F 1/185 |
| 10,101,537 | B2 * | 10/2018 | Nelson | G02B 6/3807 |
| 2009/0017693 | A1 | 1/2009 | Nagata et al. | |
| 2010/0110056 | A1 | 5/2010 | Kim et al. | |
| 2019/0131748 | A1 * | 5/2019 | Cheng | H01R 13/6597 |

FOREIGN PATENT DOCUMENTS

| | | | |
|---|---|---|---|
| JP | H09180793 | A | 7/1997 |
| JP | H09232042 | A | 9/1997 |
| JP | 2001143822 | A | 5/2001 |
| JP | 2010027256 | A | 2/2010 |
| KR | 0154825 | B1 | 11/1998 |
| KR | 20040028354 | A | 4/2004 |
| KR | 20090007212 | A | 1/2009 |
| KR | 20090102268 | A | 9/2009 |
| KR | 20100048200 | A | 5/2010 |
| KR | 20100128359 | A | 12/2010 |
| KR | 20120068265 | A | 6/2012 |
| KR | 20130085137 | A | 7/2013 |
| KR | 20170059846 | A | 5/2017 |

OTHER PUBLICATIONS

Extended European Search Report including Written Opinion for EP19819103.3 dated Mar. 10, 2021; 6 pages.

* cited by examiner

PRIOR ART

CONNECTOR HAVING SURGE PREVENTION FUNCTION AND CIRCUIT BOARD INCLUDING SAME

CROSS-REFERENCE TO RELATED APPLICATIONS

The present application is a national phase entry under 35 U.S.C. § 371 of International Application No. PCT/KR2019/002387 filed Feb. 27, 2019, published in Korean, which claims priority from Korean Patent Application 10-2018-0067736 filed Jun. 12, 2018, all of which are incorporated herein by reference.

TECHNICAL FIELD

The present disclosure relates to a connector, and more particularly, to a connector capable of preventing an unexpected surge phenomenon when the connector is connected and a printed circuit board including the connector.

BACKGROUND ART

A connector is a connection mechanism for constructing an electric circuit by connecting an electric device and a cord or connecting a cord and a cord. Generally, a connector includes a pair of female connector and male connector, which are connected to each other by a receptacle manner A plurality of female connector pins corresponding to a contact are installed at the female connector, and a plurality of male connector pins making contact with the plurality of female connector pins are installed at the male connector.

In addition, the male connector is surface-mounted to a circuit board (Surface Mount Technology (SMT)), and the female connector is complementarily fastened to the male connector. As different wires are connected to the connector pins, various signals may be transmitted to the circuit board according to the wires.

Since wires for transmitting various signals are connected to the connector, the connector pins may have different voltages. In this case, it is good to connect the connector pins to the circuit board in sequence from a ground pin to connector pins having higher voltages. However, since the conventional connector is configured to connect all the connector pins to the circuit board at the same time, so a surge often occurs when a connection pin having a high voltage is unexpectedly connected first to the circuit board.

For example, a battery module or a battery pack may include a plurality of secondary battery cells and a protection circuit module (PCM) or battery management system (BMS) for taking charge of a voltage balancing function of the secondary battery cells, and the plurality of secondary battery cells may be connected to a BMS circuit board using wires and female/male connectors.

As shown in FIG. 1, the PCM or BMS receives voltage data for each secondary battery cell and controls charge and discharge of a secondary battery cell having an unequal voltage value based on the voltage value of the secondary battery cells such that the voltage of the corresponding secondary battery cell becomes equal to the voltages of the other secondary battery cells.

However, in case of the conventional female/male connector as described above, it is impossible to know which secondary battery cell voltage will be connected to the circuit board first, and also it is impossible to manage the connection order. For example, in FIG. 1, the secondary battery cells are connected in series so that the voltage at point ① is the lowest. Here, when the female/male connectors are connected, if a connector pin corresponding to point ③ is connected to the circuit board prior to a connector pin corresponding to point ①, a surge may occur to damage a BMS chip (e.g., an ASIC) of the circuit board.

Even if the frequency of surge caused by the voltage difference of the connector pins is low, if the BMS chip is damaged due to an unexpected surge phenomenon, the BMS may not function properly to shorten the lifetime of the device, which may lead to a safety problem. Thus, it is needed to find countermeasures thereto.

SUMMARY

Technical Problem

The present disclosure is designed to solve the problems of the related art, and therefore the present disclosure is directed to providing a male connector, which may prevent a surge phenomenon when the connector is connected to a circuit board, and a circuit board including the connector.

Technical Solution

In one aspect of the present disclosure, there is provided a male connector comprising: a housing; a plurality of pins disposed in an inner space of the housing and having a front end configured to receive a female connector; and a plurality of ground connection members, each ground connection member having a first side detachably connected to a corresponding pin of the plurality of pins and a second side connected to an inner wall of the housing, wherein each of the plurality of ground connection members is positioned at a different distance from the front end of the plurality of pins such that the plurality of pins are detached from their corresponding ground connection members in sequence as the female connector is inserted into the inner space of the housing.

Each of the plurality of ground connection members may include a pin connection portion having a semicircular shape and may be adapted to be mounted to the corresponding pin to surround at least a portion of a circumference of the corresponding pin.

Each of the plurality of ground connection members may be made of an elastic material such that removal of the female connector from the inner space of the housing causes each pin connection portion to be mounted again to the circumference of the corresponding pin.

The second sides of the ground connection members may be connected to each other by a common ground line and integrally fixed to the inner wall of the housing.

The plurality of pins may be configured to be connected to a plurality of female connector pins of the female connector in one-to-one relationship, wherein each of the plurality of pins is configured to have a different voltage applied thereto from the corresponding female connector pins, and the sequence by which the plurality of pins are detached from their corresponding ground connection members may be according to an order of the different voltages applied thereto.

Each of the plurality of pins may have a different length.

Each pin of the plurality of pins may have an insulation region configured to insulate a portion of the pin from the front end to a distance from the front end, wherein the distance from the front end is different for each of the plurality of pins.

In another aspect of the present disclosure, there is also provided a printed circuit board, to which the male connector of any of the embodiments described herein is mounted.

Advantageous Effects

According to an embodiment of the present disclosure, a connector pin having a lower voltage may be electrically connected to a circuit board earlier, thereby preventing a surge phenomenon when the connector is connected to a circuit board.

It will be clearly understood by those skilled in the art that various embodiments according to the present disclosure can solve various technical problems not mentioned herein.

DETAILED DESCRIPTION

Hereinafter, preferred embodiments of the present disclosure will be described in detail with reference to the accompanying drawings. Prior to the description, it should be understood that the terms used in the specification and the appended claims should not be construed as limited to general and dictionary meanings, but interpreted based on the meanings and concepts corresponding to technical aspects of the present disclosure on the basis of the principle that the inventor is allowed to define terms appropriately for the best explanation.

Therefore, the description proposed herein is just a preferable example for the purpose of illustrations only, not intended to limit the scope of the disclosure, so it should be understood that other equivalents and modifications could be made thereto without departing from the scope of the disclosure.

In the following description, a circuit board may refer to a BMS circuit board applied to a battery pack for a vehicle. Here, the BMS circuit board is a component of the battery pack for controlling charge and discharge of battery cells and cell balancing.

A male connector 20 according to the present disclosure may be used to transmit voltage information of secondary battery cells to a BMS chip together with a female connector 10 provided in the form of a cable connector. Here, the scope of the present disclosure is not limited to this use. That is, the male connector 20 according to the present disclosure may also be used to connect various signal transmission cables to electrical tools such as laptops, tablet PCs and smart phones.

Figure 2:
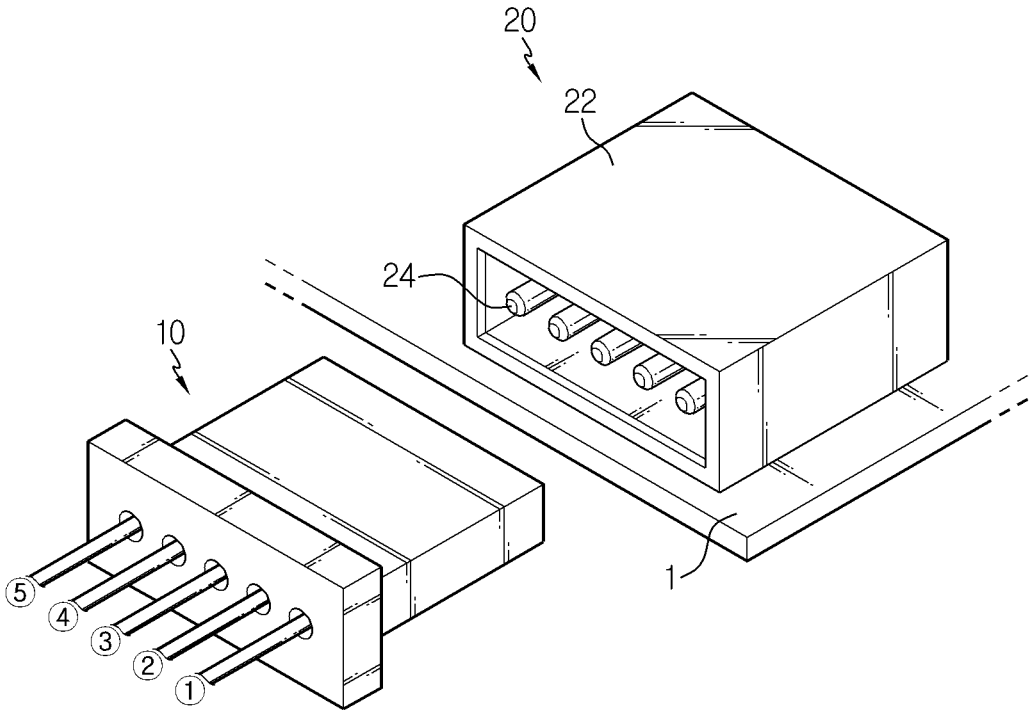
FIG. 2 is a schematic perspective view showing a male connector installed at a circuit board according to an embodiment of the present disclosure.
Figure 3:
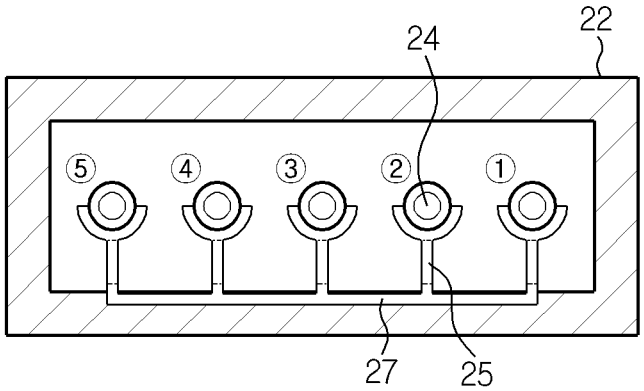
FIG. 3 is a longitudinal sectioned view showing the male connector of FIG. 2.
Figure 4:
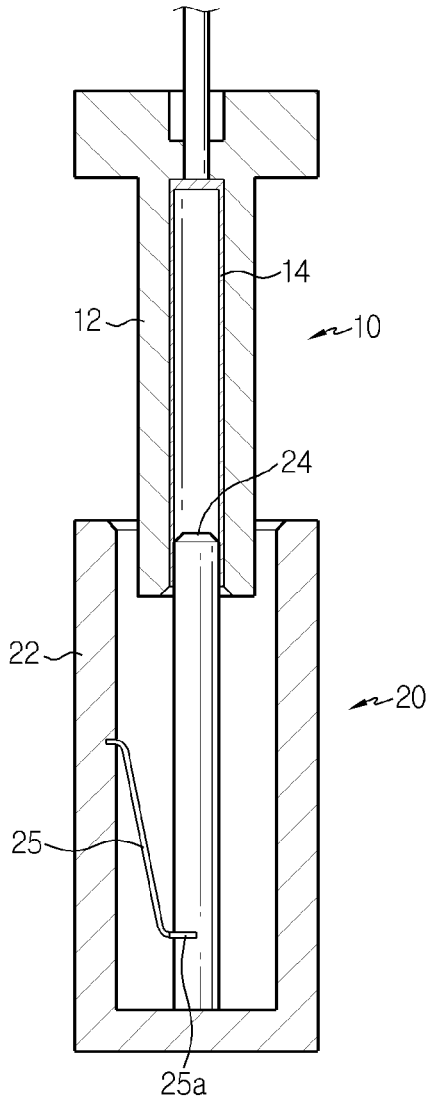
FIGS. 4 and 5 are diagrams for illustrating operations of a ground connection member according to an embodiment of the present disclosure.
Figure 5:
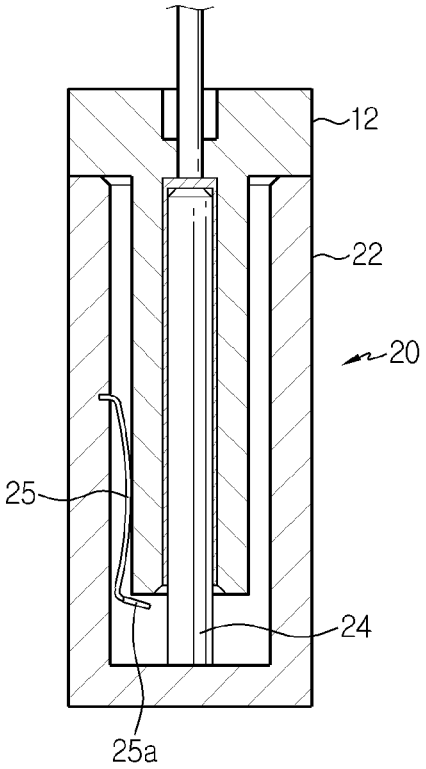
Figure 6:
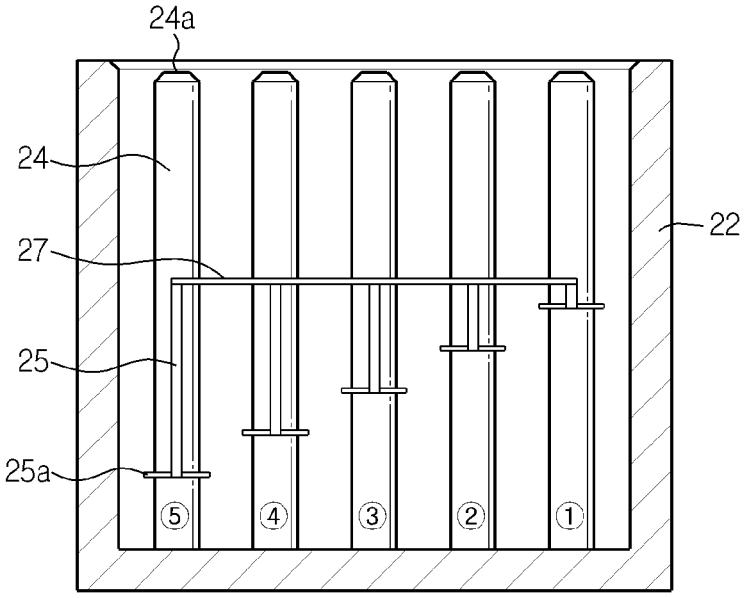
FIG. 6 is a cross-sectioned view showing the male connector of FIG. 2.

FIG. 2 is a schematic perspective view showing the male connector 20 installed at the circuit board according to an embodiment of the present disclosure, FIG. 3 is a longitudinal sectioned view showing the male connector 20 of FIG. 2, FIGS. 4 and 5 are diagrams for illustrating operations of a ground connection member 25 according to an embodiment of the present disclosure, and FIG. 6 is a cross-sectioned view showing the male connector 20 of FIG. 2.

Referring to the figures, the male connector 20 according to an embodiment of the present disclosure includes a male connector housing 22, a male connector pins 24, and a ground connection member 25.

As shown in FIG. 2, the male connector 20 may be disposed at an edge of one side of a BMS circuit board 1 and is provided to be connected to and disconnected from the female connector 10 in a plug-in manner Though not shown in the figures for the sake of convenience, the male connector pin 24 is connected to conductor patterns of the circuit board 1, and the conductor patterns are connected to a BMS chip (ASIC).

The male connector housing 22 is a component serving as a frame for surrounding the male connector pins 24 to be protected against the outside and is made of an insulating material such as plastic. The male connector housing 22 may be fixed to the circuit board 1 by a fastening unit such as a screw or a hook.

In addition, the male connector housing 22 has an opening at one side thereof so that the female connector 10 corresponding thereto may be inserted inwardly through the opening.

The male connector pins 24 are provided in the inner space of the male connector housing 22, and the female connector pins 14 are electrically connected to the male connector pins 24. The male connector pins 24 may have one ends connected to the conductive patterns of the circuit board 1 and the other end extending straight toward the opening.

For example, the male connector pin 24 may be in the form of a rod or plug, and the female connector pin 14 may be in the form of a socket or receptacle capable of being coupled to the male connector pin 24 in a plug-in manner.

Figure 1:
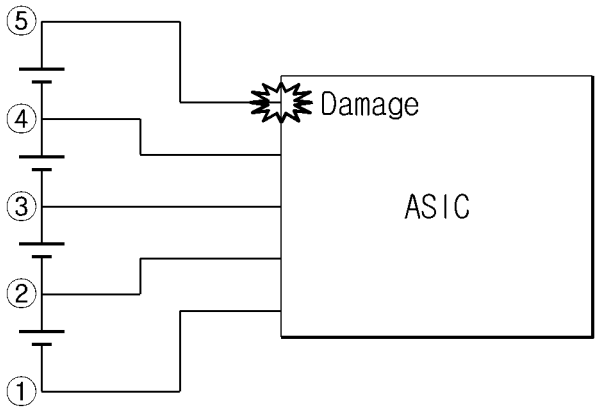
FIG. 1 is a schematic circuit diagram showing a conventional BMS protection circuit.

The number of the female/male connector pins 14, 24 may be determined by the number of signals to be transmitted or received. For example, the female/male connectors 10, 20 of this embodiment have five pins as female/male connectors 10, 20 used for transmitting voltage information of four battery cells to the BMS. Referring to FIG. 1, at nodes where the battery cells are connected in series, voltages are higher in the order of points ⑤, ④, ③, ②, ①. The points are connected to cables shown in FIG. 2, and the cables are connected to the female connector pins 14, respectively. By connecting five female connector pins 14 to five male connector pins 24, voltage information of the battery cells may be transmitted to the BMS.

Meanwhile, the male connector 20 according to an embodiment of the present disclosure further includes ground connection members 25 in order to prevent an unexpected surge phenomenon, caused by transmitting lower voltage information to the BMS earlier when the female connector pins 14 are integrally connected to the male connector pins 24.

Hereinafter, the configuration and operation of the ground connection members 25 will be described in detail.

Referring to FIGS. 3 to 5, the ground connection member 25 according to this embodiment is made of an elastic metal material and includes a pin connection portion 25*a* of a semicircular shape. The pin connection portion 25*a* may be provided to surround at least a portion of the circumference of the male connector pin 24.

In addition, one end of the ground connection member 25 is fixed to one side of an inner wall of the male connector housing 22, and the pin connection portion 25*a* extending obliquely toward a terminal of the male connector pin 24 and forming the other end of the ground connection member 25 may be provided to elastically contact the circumference of the male connector pin 24.

The ground connection member 25 has one side connected to the male connector pin 24 and the other side connected to the inner wall of the male connector housing 22 to serve as a ground line for grounding the male connector pin 24 to the male connector housing 22.

Thus, even if the female connector pin 14 is connected to the male connector pin 24, the voltage of the female connector pin 14 is not transmitted to the BMS in a state where the ground connection member 25 is not disconnected from the male connector pin 24.

That is, as shown in FIG. 5, only when the female connector 10 is inserted to a predetermined depth inside the male connector housing 22, the ground connection member 25 may be tilted by the front end of the female connector housing 12 and separated from the male connector pin 24. When the ground connection member 25 is disconnected from the male connector pin 24 as described above, the voltage of the female connector pin 14 may be transmitted to the BMS.

In addition, if the female connector 10 is drawn out from the male connector housing 22 so that the force acting on the ground connection member 25 is lost, the ground connection member 25 is restored to its original position due to elasticity so that the pin connection portion 25*a* is mounted again to the circumference of the male connector pin 24 and thus may be connected to the male connector pin 24 again.

The ground connection member 25 may be provided in plural, and the plurality of ground connection members 25 are provided to correspond to the male connector pins 24 in one-to-one relationship. That is, in this embodiment, five ground connection members 25 are provided, and the ground connection members 25 are individually connected to five male connector pins 24.

As shown in FIG. 6, since the pin connection portions 25*a* are mounted at positions spaced apart from the front ends 24*a* of the corresponding male connector pins 24 by predetermined distances, the five ground connection members 25 may be connected to the male connector pins 24 at different positions. In other words, the ground connection members 25 are connected to the male connector pins 24 such that a male connector pin 24 corresponding to a female connector pin 14 having a relatively higher voltage is connected thereto at a position farther from the front end 24*a* of the male connector pin 24.

Specifically, in this embodiment, the female connector pins 14 are connected to the ①, ②, ③, ④, ⑤ male connector pins 24 of FIG. 6 such that voltages at the points ①, ②, ③, ④, ⑤ of FIG. 1 are applied thereto. The pin connection portion 25*a* of the ground connection member 25 is mounted to the male connector pin ⑤ at a position farther from the front end 24*a* inn comparison to the male connector pin ④, and the pin connection portions 25*a* of the ground connection members 25 are mounted to the remaining male connector pins 24 in the same pattern as above.

According to this configuration, the ground connection members 25 may be separated in sequence from the male connector pins 24 according to the depth by which the female connector 10 is inserted into the housing of the male connector 20. In other words, while the female connector 10 is being completely inserted into the male connector housing 22, the ground connection members 25 of the ①, ②, ③, ④, ⑤ male connector pins 24 may be separated in order. In this case, when the female/male connector 20 is connected, the male connector pins 24 are electrically connected to the BMS in the order of the male connector pins 24 having a lower voltage, thereby preventing an unexpected surge phenomenon.

Meanwhile, the ground connection members 25 according to an embodiment of the present disclosure may be integrally fixed to the inner wall of the male connector housing 22 such that the other sides of the ground connection members 25 are connected to each other by a common ground line 27.

If the ground connection members 25 are individually fixed to the inner wall of the male connector housing 22 without the common ground line 27, when any one ground connection member 25 is separated from the inner wall of the male connector housing 22, the above mechanism for transmitting voltage to the BMS becomes impossible. However, if the common ground line 27 is provided as in this embodiment, the ground connection members 25 may be more stably fixed to the inner wall of the male connector housing 22. Also, unless the entire common ground line 27 is separated from the inner wall of the male connector housing 22, all the ground connection members 25 may properly serve as a ground line, thereby effectively securing the ground stability.

In addition, even if the common ground line 27 is separated from the inner wall of the male connector housing 22, as long as the ground connection member 25 of, for example, the pin ① among the male connector pins 24 serving as a ground pin is not separated from the male connector pin 24, the function of the ground line of the other ground connection members 25 may be maintained.

In other words, in this embodiment, among the male connector pins 24, the pin ① is a ground pin, and the ground pin is connected to the ground portion (GND) of the circuit board 1. The ground connection members 25 of the pins ②, ③, ④, ⑤ may be grounded to the circuit board 1 since they are connected to the pin ①, namely the ground pin 1, by the common ground line 27, even though they are not grounded to the inner wall of the male connector housing 22.

In this state, even if the female connector 10 is connected to the male connector 20, the voltage of the pin ① may be transmitted to the BMS first, thereby reducing the possibility of surge.

Figure 7:
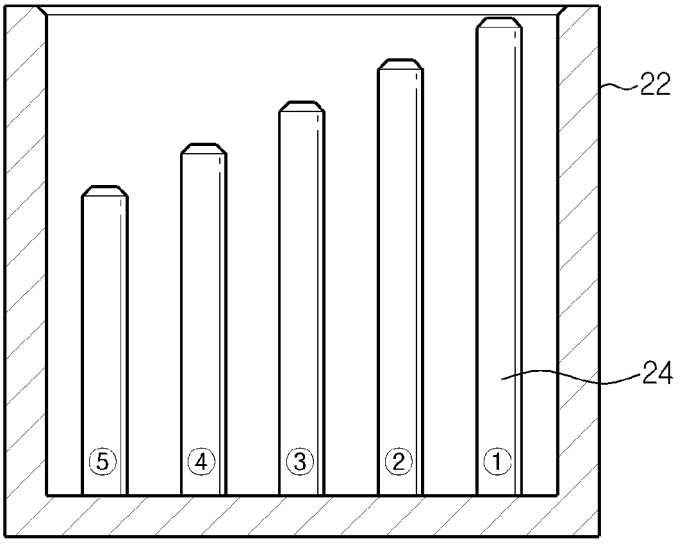
FIG. 7 is a diagram showing male connector pins according to another embodiment of the present disclosure.
Figure 8:
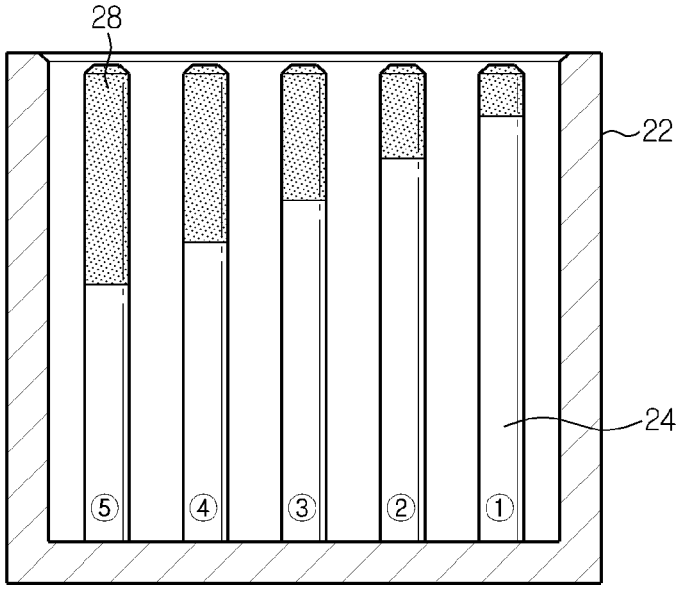
FIG. 8 is a diagram showing male connector pins according to still another embodiment of the present disclosure.

FIG. 7 is a diagram showing male connector pins 24 according to another embodiment of the present disclosure, and FIG. 8 is a diagram showing male connector pins 24 according to still another embodiment of the present disclosure.

Subsequently, other embodiments of the present disclosure will be described with reference to FIGS. 7 and 8. The same reference numerals denote the same members and will not be described again herein. The following description will be focused on features different from the former embodiment.

Referring to FIG. 7, in the male connector 20 according to the second embodiment of the present disclosure, the male connector pins 24 may have a different length, compared to the first embodiment described above.

For example, the male connector pin 24, which transmits a relatively high voltage, may be shorter than the male connector pin 24, which does not transmit a relatively high voltage. That is, as shown in FIG. 7, the male connector pins 24 may be longer in the order of pins ①, ②, ③, ④, ⑤. In this case, even though the female connector pins 14 as in the former embodiment are used, the male connector pins 24 contact the female connector pins 14 in the order of pins ①, ②, ③, ④, ⑤. Thus, according to the second embodiment of the present disclosure, even though the ground connection members 25 do not perform the ground function properly, the voltage may be transmitted to the BMS in the order of a lower voltage to a high voltage, thereby preventing surge.

In addition, referring to FIG. 8, in the male connector 20 according to the third embodiment of the present disclosure, each of the male connector pins 24 may have an insulation region 28 that are insulated from the front end 24*a* to a predetermined position, compared to the former embodiment.

For example, the insulation regions 28 of the male connector pins 24 are insulated such that an insulation region 28 of a male connector pins 24, which transmits a higher voltage, is electrically isolated farther from the front end 24*a*. That is, as shown in FIG. 8, the insulation regions 28 may be provided longer in the order of pins ④, ④, ③, ②, ①. In this case, even though the female connector pins 14 as in the former embodiments are used, the male connector pins 24 are electrically connected to the female connector pins 14 in the order of pins ①, ②, ③, ④, ⑤. Thus, in the third embodiment of the present disclosure, even though the ground connection members 25 do not perform the ground function properly, the voltage may be transmitted to the BMS in the order of a lower voltage to a high voltage, thereby preventing surge.

According to the configuration and operation of the male connector 20 according to the embodiments of the present disclosure as described above, when the connector is connected to the circuit board 1, surge phenomenon may be effectively prevented just by using a simple structure without excessive design change of the male connector 20.

Meanwhile, the printed circuit board 1 according to the present disclosure may include at least one male connector 20 described above. The male connector 20 may be fixedly mounted to an edge of one side of the printed circuit board 1. The printed circuit board 1 may be used not only as a circuit board 1 for in a battery pack to which a BMS chip is mounted but also a circuit board 1 for an electric device such as a laptop, a tablet PC and a smart phone.

The present disclosure has been described in detail. However, it should be understood that the detailed description and specific examples, while indicating preferred embodiments of the disclosure, are given by way of illustration only, since various changes and modifications within the scope of the disclosure will become apparent to those skilled in the art from this detailed description.

Meanwhile, even though the terms expressing directions such as "upper", "lower", "left" and "right" are used in the specification, they are just for convenience of description and can be expressed differently depending on the location of a viewer or a subject, as apparent to those skilled in the art.

What is claimed is:

1. A male connector comprising:

a housing;

a plurality of pins disposed in an inner space of the housing and having a front end configured to receive a female connector; and a plurality of ground connection members, each ground connection member having a first side detachably connected to a corresponding pin of the plurality of pins and a second side connected to an inner wall of the housing, wherein each of the plurality of ground connection members is positioned at a different distance from the front end of the plurality of pins such that the plurality of pins are detached from their corresponding ground connection members in sequence as the female connector is inserted into the inner space of the housing.

2. The male connector according to claim 1, wherein each of the plurality of ground connection members includes a pin connection portion having a semicircular shape and is adapted to be mounted to the corresponding pin to surround at least a portion of a circumference of the corresponding pin.

3. The male connector according to claim 2, wherein each of the plurality of ground connection members is made of an elastic material such that removal of the female connector from the inner space of the housing causes each pin connection portion to be mounted again to the circumference of the corresponding pin.

4. The male connector according to claim 1, wherein the second sides of the ground connection members are connected to each other by a common ground line and integrally fixed to the inner wall of the housing.

5. The male connector according to claim 1, wherein the plurality of pins are configured to be connected to a plurality of female connector pins of the female connector in one-to-one relationship, wherein each of the plurality of pins is configured to have a different voltage applied thereto from the corresponding female connector pins, and wherein the sequence by which the plurality of pins are detached from their corresponding ground connection members is according to an order of the different voltages applied thereto.

6. The male connector according to claim 1, wherein each of the plurality of pins has a different length.

7. The male connector according to claim 1, wherein each pin of the plurality of pins has an insulation region configured to insulate a portion of the pin from the front end to a distance from the front end, wherein the distance from the front end is different for each of the plurality of pins.

8. A printed circuit board, comprising a male connector according to claim 1 mounted to the printed circuit board.

* * * * *